US006964341B2

(12) United States Patent
Bacho et al.

(10) Patent No.: US 6,964,341 B2
(45) Date of Patent: Nov. 15, 2005

(54) SCREEN PANEL RETAINER SYSTEM

(75) Inventors: Frank J. Bacho, Princeton, WV (US); James D. Connolly, Princeton, WV (US)

(73) Assignee: Conn-Weld Industries, Inc., Princeton, WV (US)

( * ) Notice: Subject to any disclaimer, the term of this patent is extended or adjusted under 35 U.S.C. 154(b) by 34 days.

(21) Appl. No.: 10/766,864

(22) Filed: Jan. 30, 2004

(65) Prior Publication Data

US 2005/0167341 A1 Aug. 4, 2005

(51) Int. Cl.[7] ..... B07B 1/00
(52) U.S. Cl. ..... 209/405
(58) Field of Search ..... 209/405, 404, 209/393, 319, 399, 413

(56) References Cited

U.S. PATENT DOCUMENTS 3,795,311 A * 3/1974 Martin ..... 209/395
4,046,347 A * 9/1977 Bryan ..... 248/346.02
4,909,929 A * 3/1990 Tabor ..... 209/400
5,112,475 A * 5/1992 Henry, Jr. ..... 209/399
5,277,319 A * 1/1994 Henry, Jr. ..... 209/399
5,361,911 A * 11/1994 Waites et al. ..... 209/399
5,398,817 A * 3/1995 Connolly et al. ..... 209/399
6,206,200 B1 * 3/2001 Gilles et al. ..... 209/399

* cited by examiner

*Primary Examiner*—Kathy Matecki
*Assistant Examiner*—Terrell Matthews
(74) *Attorney, Agent, or Firm*—Jones Tullar & Cooper, PC

(57) ABSTRACT

A screen panel retainer system is useable to retain a plurality of screen panels to a separatory machine. Retainer bars are attached to the screen stringer rails of the separatory machine by an expanding of spaced plugs that are received in holes in the stringer rails. The retainer bars each include a plurality of ears that are receivable in pockets that are situated on the inner faces of screen panel edge strips. A plurality of dams, each of which is securable to the screen edge strip ends of two adjacent screen panels, serve to further secure the screen panels in place. Screen panel removal is easily accomplished and the system is adaptable to various machine configurations.

19 Claims, 7 Drawing Sheets

SCREEN PANEL RETAINER SYSTEM

FIELD OF THE INVENTION

The present invention is directed generally to a screen panel retainer system. More particularly, the present invention is directed to a screen panel retainer system for use in securing screen panels to a frame of a vibrating separatory device. Most specifically, the present invention is directed to a screen panel retainer system that utilizes elongated retainer bars, including self-expanding retainer pins and screen panel edge engaging ears, which are receivable in cooperatively shaped pockets in screen panel edge strips. The retainer pins on the elongated retainer bars are spaced to be receivable in the spaced holes or apertures which are typically situated on the upper surface of screen stringer rails provided in vibrating separatory machines. The retainer pins are expandable to securely hold the retainer bars in place and to thus retain the screen panels. The retainer bar ears releasably receive the screen panel edge strips. The screen panel retainer system of the present invention is equally suitable for use with separatory machines whose spaced screen stringer rail holes are of their proper dimension as well as those whose rail holes have become oversize due to wear.

BACKGROUND OF THE INVENTION

Vibrating and other separatory screen assemblies are generally known in the art and are very useful in accomplishing the separation of materials on the basis of size of the materials to be separated. A slurry of liquid and entrained solids will be caused to run or flow across an upper surface of a screen panel assembly. Particles of a certain size and above will not pass through apertures in the screen panels and will thus be separated out. The screen panel assembly is caused to vibrate by an suitable means with this vibratory motion being beneficial in facilitating the proper separation of the material directed to the screen panel.

One such vibratory screen panel assembly is shown in U.S. Pat. Nos. 5,112,475 and 5,277,319, both the Henry, and both assigned to Conn-Weld Industries, the assignee of the present application. In these two patents, there is disclosed a panel mounting system for a vibrating screen assembly, and a panel which is securable in the vibrating screen assembly using the panel mounting system. A plurality of screen panels are secured to a panel deck of a frame portion of a vibrating screen assembly. A plurality of elongated hold downs or center retainers, which are made of a resilient elastomeric material, such as polyurethane, are provided with spaced anchoring pins along their bottom surface. These anchoring pins are receivable in apertures in an anchor member. Once the hold down members or center retainers have been secured to the anchor member, which is, in turn, attached to spaced cross members or tubes of the frame of the vibratory separator, the screen panels are placed atop the panel deck with their side edges in contact with the center retainers. Elongated key members are inserted into upwardly facing slots in the center retainers to spread wing portions of the retainers laterally outwardly. This spreading of the wings of the center retainers causes the wings to grip the side edges of the screen panels so that these panels are secured in the vibrating screen assembly.

The panel mounting system disclosed in the two above-referenced Henry patents, which are assigned to Conn-Weld Industries, utilizes screen panels and cooperating anchor members which are bolted, welded or otherwise secured to cross members of the panel deck of the vibrating screen assembly. An owner of a vibrating screen apparatus which is not provided with the appropriate anchor members disclosed in the prior Henry patents must make substantial revisions and modifications to his vibrating screen assembly if he is to be able to enjoy the advantages of the Conn-Weld Industries panel mounting system.

A center retainer assembly for a panel mounting system is disclosed in U.S. Pat. No. 5,398,817 to Connolly et al. and also assigned to Conn-Weld Industries. The center retainer assembly described in the '817 patent utilizes an elongated bolting bar which is encased in a resilient material and which includes an elongated center retainer. The center retainer assembly is placed into an upwardly facing retainer channel and is secured to the retainer channel by placement of the bolts carried by the bolting bar through holes in the retainer channel. The retainer channel is, in turn, secured to mounting plates that are attached to a cross tube or to a cross bar of a vibrating screen assembly.

Each of the screen panel retainer systems described in the above-mentioned patents has performed well and has been accepted by the industry. However, each still has required that the industry standard configuration of screen stringer rails placed atop cross tubes or cross bars of the frame portion of a vibrating separatory machine be modified in some way. Such modifications or re-fittings inevitably take time, require the services of technicians and meet with resistance on the part of equipment owners who want to purchase screen panels and panel retainers that will fit the machinery they already have, without the need for any modification, revision, re-working or equipment downtime.

Thus the need still exists for a screen panel retainer system that is compatible with current industry standard screening machines. In addition, the screen panel retainer system must have the capability to accommodate to both new machines, as well as to older, used machines. The screen stringer rails which are secured atop the cross tubes or cross bars of the typical vibrating separatory machine, are typically configured with spaced holes along their upper faces. These spaced holes are used for the attachment of the screen panels to the machine's frame.

When the machine is new, all of the holes on the screen stringer rails are of uniform size. A number of currently available screen panel retention systems depend on the proper dimensioning of those holes to accomplish the securement of the screen panels to the machine frame.

Vibrating separatory machines are frequently used in applications in which a relatively abrasive material is separated from a suspension fluid, such as water. The slurry of fine abrasive particles and the suspension fluid finds its way into all of the components of the screen assembly, including into the spaces that exist between the screen panel connection mechanisms and the holes or apertures in the screen stringer rails. Over the course of time, the slurry abrades the holes and causes them to enlarge. This abrading action is enhanced by the vibration to which the separtory machine is continually subjected.

Eventually, these holes in the screen stringer bars become enlarged. Since a number of the currently available panel retainer systems utilize some type of an interference fit of pins, pegs or the like into these holes, their enlargement is problematic. At some point, the stringer bar holes become so enlarged that they will no longer engage the pins or pegs with sufficient retentive force. At such time, the stringer bars have to be refurbished, the screen panel retainers have to be modified or the stringer bars simply have to replaced with new bars. In each instance, the process involves considerable work and the equipment being taken out of service.

A need thus exists for a screen panel retainer system which is suitable for use with stringer bars whose mounting holes are both properly sized and also ones that have become oversized due to wear. The screen panel retainer system of the present invention provides a device and an assembly which can accommodate a much greater variance in screen stringer rails than has been possible in prior systems. the screen panel retainer system of the present invention is a substantial improvement over the presently available systems.

SUMMARY OF THE INVENTION

It is an object of the present invention to provide a screen panel retainer system.

Another object of the present invention is to provide a screen panel retainer system useable to secure screen panels to a frame of a vibrating separatory machine.

A further object of the present invention is to provide a screen panel retainer system which include elongated panel retainer bars with self-expanding retainer pins.

Still another object of the present invention is to provide a screen panel retainer system which is configured for use with industry standard vibrating separatory machine configurations.

Yet a further object of the present invention is to provide a retainer system that will accommodate variations in hole sizes in screen stringer rails.

Even another object of the present invention is to provide a screen panel retainer system which requires no modification of existing vibrating separatory machines.

As will be discussed in detail in the description of the preferred embodiment, which is set forth subsequently, the screen panel retainer system in accordance with the present invention is usable in a vibrating separatory device to secure screen panels to existing screen stringer rails that are provided with spaced holes on their upper faces. The screen panels are retained in place by being provided with longitudinally extending screen edge strips that are configured with periodically spaced transverse pockets. These pockets are configured to releasably receive ears that extend up from elongated center and edge retainer bars. The retainer bars are molded from a resilient material, such as polyurethane and includes a central, also elongated metal spine. The spine has a plurality of longitudinally spaced apertures, with each such aperture being sized to receive a hex-headed expander bolt. The polyurethane retainer bar also is formed with a plurality of downwardly extending retainer plugs. Each such retainer plug underlies an aperture in the metal spine. Each retainer plug includes a threaded expander nut. The plugs are sized and configured to be insertable into the cooperatively spaced holes which are situated along the top face of the screen stringer rails. Once the plugs have been placed in the rail holes, suitable expander bolts are inserted through the apertures in the spine and are threaded into the expander nuts. As the expander nuts are drawn up toward the lower surface of the retainer bar underlying the spine, the polyurethane plugs, which each encase one of the expander nuts, expand radially. This radial expansion increases the diameter and circumference of each plug so that it will not pull out of the screen retainer rail hole into which it has been inserted.

Once the retainer bars are in place, the screen panels can be attached to them. This is done by snap-fitting the ears on the retainer bars into the cooperating shaped pockets on the screen edge strips. The retainer bar ears have tabs or hooks which fit into sockets in the screen edge strip pockets. These engagements are analogous to tongue and groove connections. The ears and the screen edges are sufficiently resilient so that there is sufficient deflection of the ear hooks and the socket edges of the pockets to allow this snap-fit of the ears in the pockets.

A plurality of dams are used to bridge the ends of each two longitudinally adjacent screen panels. These dams each include a metal reinforcement rod. The ends of each dam are provided with dam end pockets that are essentially the same, in shape as the screen edge strip side pockets. Once the screen panels have been installed, the transverse dams are then snap-fit into place. These dams act as screen panel end retainers. They key into the ends of the screen panel edge strips of each two longitudinally adjacent screen panels. They also extend transversely between laterally adjacent screen panels or between a screen panel and an adjacent machine side plate. The dams further act in their generally well-known manner to slow down the flow of the material being separated, or sized as it flows longitudinally over and through the profile wires that typically make up the screen panels.

The screen panel retainer system of the present invention is usable with various vibrating separatory machines while requiring no modification of the machines. The screen stringer rails on virtually all of the currently available machines have a standard hole configuration on their upper face. The downwardly extending plugs of the center and side retainer bars of the present invention are spaced and sized to fit into those stringer bar holes. There is no need for the use of additional adapters, plates, bolting mechanism or the like, as has been the case in prior devices. The plugs are so spaced and sized that they align with, and fit into the screen stringer rail holes. A vibrating separatory machine owner can thus adapt his machine to use the screen panels provided with the screen panel retainer assembly of the present invention with virtually no modification to his machine.

The plugs of the center and side screen edge retainer bars are molded of a resilient material, typically polyurethane. They each include an expander nut. The plugs themselves are configured to be snugly received in the screen stringer rail holes. Each plug has a small flair or lip adjacent its attachment to the undersurface of the retainer bar. In use, when the retainer bar is initially placed atop the stringer rail, and the plugs are pushed into the holes, the interference lip and the tip should be sufficient to prevent the retainer bars from falling off the stringer rails. After the expansion bolts have been threaded into the expansion nuts, and the nuts have been drawn up toward the retainer bar to expand the plugs radially, the retainer bar is firmly secured to its associated screen stringer rail.

As was mentioned previously, the size of the screen stringer rail holes tend to enlarge over the service life of the vibrating separatory machine. This hole enlargement has, in the past required the replacement of the screen stringer rails because the prior screen panel retention systems relied on an interference fit with only very limited possibly of expansion. In contrast, the plugs of the subject screen panel retainer system are expandable radially to an increased size that will vary with the travel distance of the expander nut toward the undersurface of the retainer bar. If the diameter of the screen retainer rail holes increases, due to abrasive action of the slurry being processed, the expansion bolts of the present screen panel retainer system can be rotated to pull the expander nuts closer to the retainer bar. The effect of this is the further radial expansion of the retainer bar plugs. Such further radial expansion will compensate for screen stringer rail hole size increases. The screen panel retainer system of the present invention is thus also easily adapted for use with new machines as well as with older machines, without requiring that the screen stringer rails of these older machines be replaced.

The screen panel retainer system in accordance with the present invention overcomes the limitations of the prior art. It is essentially universally usable with a wide variety of vibrating separatory machines. It is adaptable to a range of hole sizes caused by machinery use. The screen panel retainer system of the present invention is thus a substantial advance in the art.

BRIEF DESCRIPTION OF THE DRAWINGS

While the novel features of the screen panel retainer system in accordance with the present invention are set forth with particularly in the appended claims, a full and complete understanding of the invention may be had by referring to the detailed description of the preferred embodiment which is presented subsequently, and as illustrated in the accompanying drawings, in which:

DESCRIPTION OF THE PREFERRED EMBODIMENT

Figure 1:
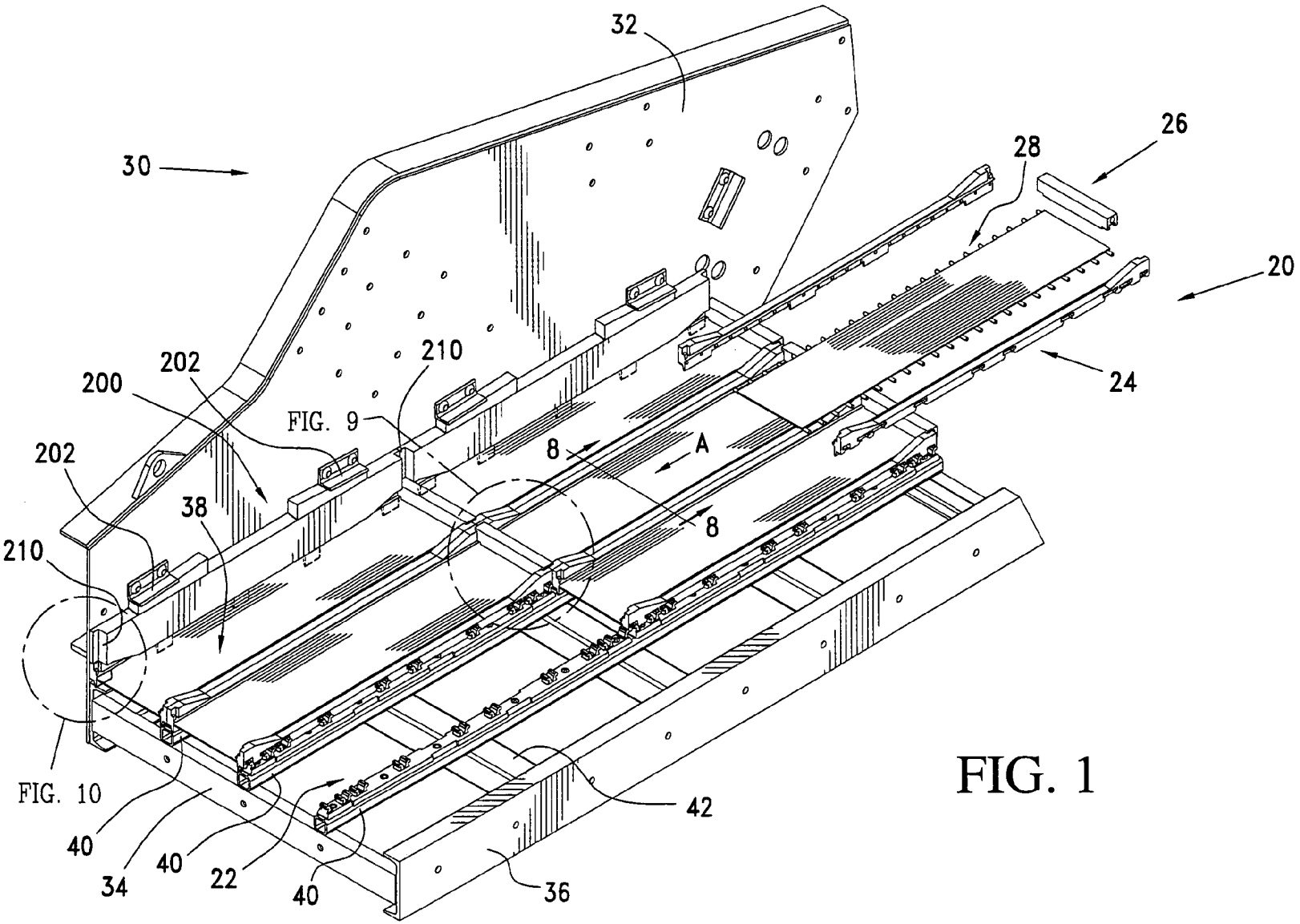
FIG. 1 is a perspective view of a portion of a vibrating separatory machine and showing, in exploded perspective, portions of the screen panel retainer system in accordance with the present invention.

Referring initially to FIG. 1, there may be seen generally at 20 a preferred embodiment of a screen panel retainer system in accordance with the present invention. Screen panel retainer system generally at 20 includes elongated retainer bars, generally at 22, which are adapted to receive screen edge strips 24 and to also receive end dams 26. These retainer bars 22, edge strips 24 and end dams 26 form a retainer system intended to removably attach screen panels, such as screen panel 28 to a vibrating separatory machine, that is depicted somewhat schematically at 30 in FIG. 1. It will be understood that the vibrating separatory machine 30 depicted in FIG. 1 is representative of various machines of this type which are provided by a variety of manufacturers and which are used in numerous industrial applications to classify and separate particulate matter, typically in the form of a slurry of particles and water. Such vibrating separatory machines 30 typically include a pair of side panels 32, only one of which is depicted in FIG. 1. A plurality of cross tubes 34 extend between a pair of longitudinally extending side panel channel iron frame member 36. The cross tubes 34 are generally transverse to a flow direction, indicated by arrow A in FIG. 1, of material along the screen panel bed 38 of the separatory machine 30. The cross tubes 34 are spaced longitudinally from each other, as seen in FIG. 1.

A number of longitudinally extending screen stringer rails 40 are secured to top faces 42 of the transversely spaced cross tubes 34. These screen stringer rails 40 extend generally in the material flow direction A. In a typical vibrating separatory machine 30 each screen stringer rail 40 is a square stainless steel tube with an outer wall height and width of 2 inches and with a wall thickness of ¼ inch. It will be understood that the vibrating separatory machine 30 described above, and as will be further described subsequently, forms no part of the subject invention. It is the base to which the screen panels 28 are attached by operation of the screen panel retainer system 20 of the present invention.

Figure 4:
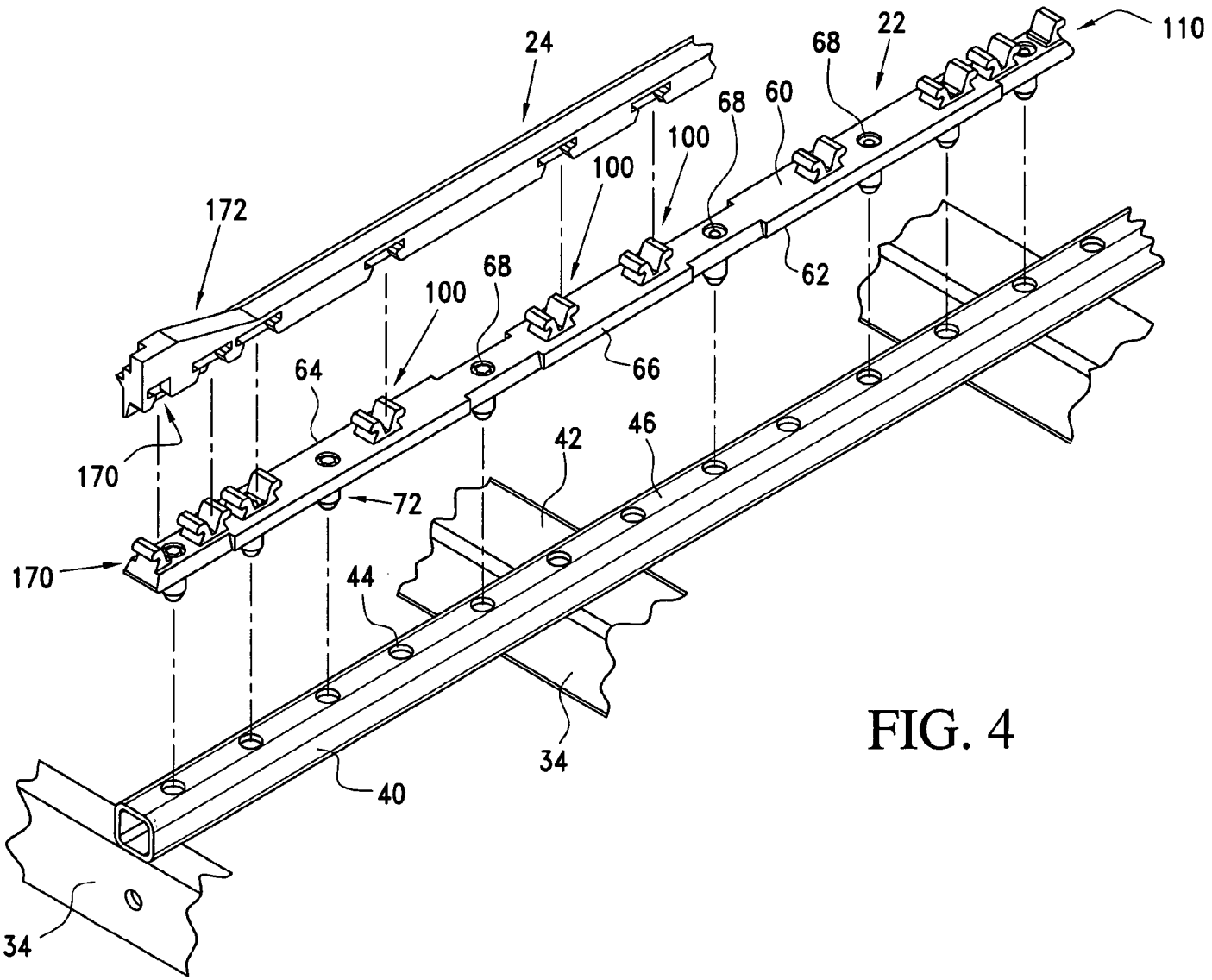
FIG. 4 is an exploded perspective view of a center retainer bar and of a screen edge strip in accordance with the present invention and depicted as being engageable with a screen stringer rail of a vibrating separatory machine.

As may be seen most clearly in FIG. 4, and as discussed above, each screen stringer rail 40 is essentially a square stainless steel tube with a plurality of holes 44 evenly longitudinally spaced along a top face 46 of each screen stringer rail 40. These holes 44 are typically ⅞ inch in diameter and are spaced at 4 inch centers along the top face 46 of the screen stringer rail 40. This hole spacing has been, at least unofficially adopted as an industry standard and is typically found on machines of this type, irrespective of the manufacturer of the machine.

Figures 5, 6, 7:
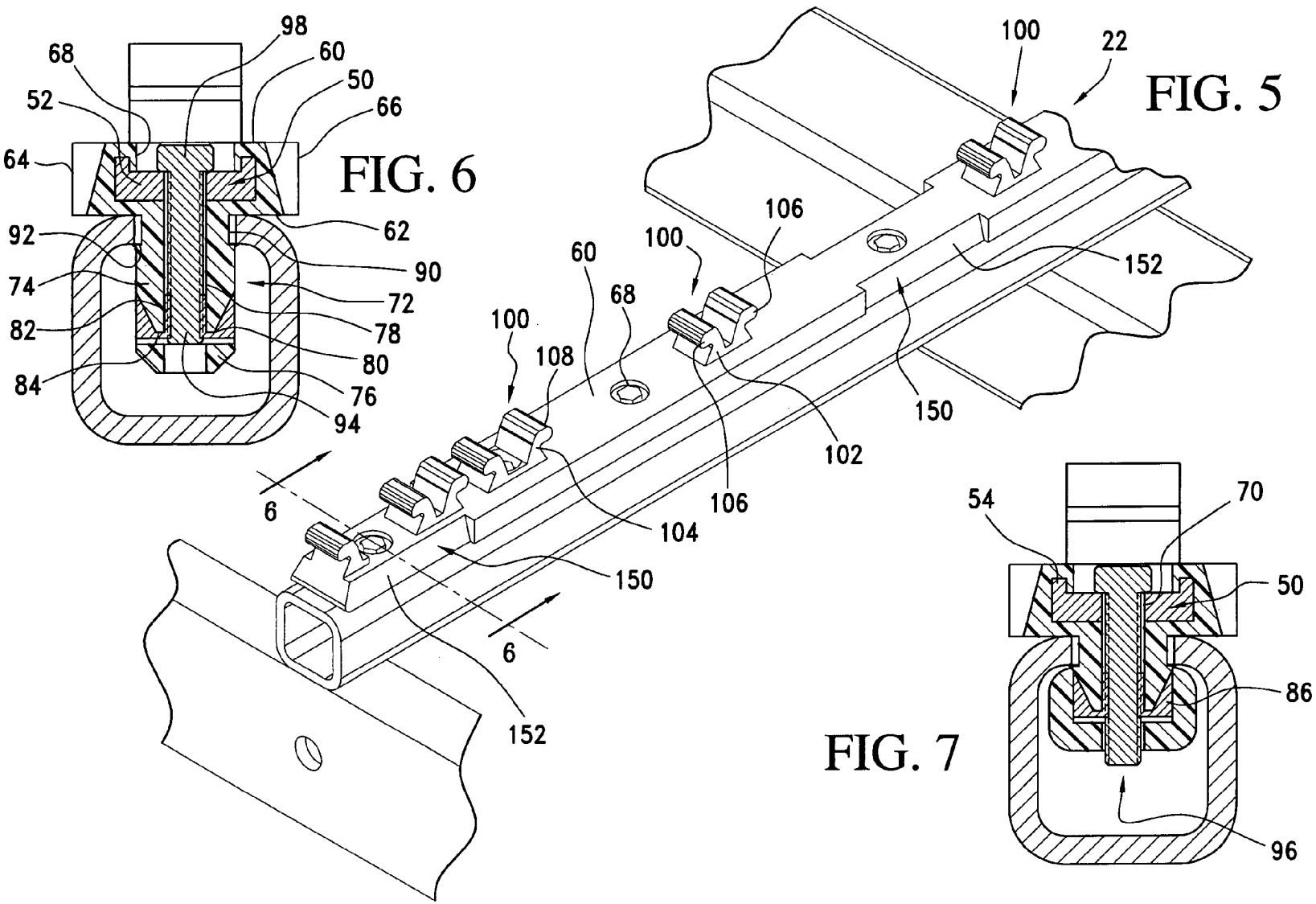
FIG. 5 is a perspective view of a portion of a center retainer bar attached to a stringer rail which is, in turn, positioned on spaced cross tubes of a separatory machine.
FIG. 6 is a cross-sectional view taken along line 6—6 of FIG. 5, with the plug of the center retainer bar shown in its unexpanded position.
FIG. 7 is a cross-sectional view similar to FIG. 6 and showing the plug in an expanded, stringer rail engaging position.

Referring again to FIG. 4, each of the retainer bars, generally at 22 is an elongaged bar that is molded of a resilient material, such as polyurethane. As may be seen in FIGS. 6 and 7, a metal spine 50 is molded into each retainer bar 22. The metal spine 50 is typically an elongated metal strip that has a width of 1¼ inches and a thickness of ⅜ inch. The metal spine 50 is typically made of steel. As seen in FIGS. 6 and 7, it is somewhat channel shaped and includes a central web 52 and spaced side flanges 54. The steel spine 50 is embedded in the elongated retainer bar during molding of the polyurethane about the spine 50.

Retainer bar 22 is generally rectangular in cross-section and has a length sufficient to receive at least one edge of a screen panel 28, as will be discussed subsequently. The bar 22 has an upper surface 60, a lower surface 62, as seen more clearly in FIGS. 6 and 7, and sides 64 and 66. A plurality of chamfers 68 are spaced along the length of each retainer bar and are spaced along the upper face 60 of each retainer bar. These chamfers 68 overlie bores 70 which are spaced longitudinally along the spine 50. These bores 70, as depicted in FIGS. 6 and 7, are not threaded. They are spaced to coincide with the hole spacing of the holes 44 on the upper surface of the screen stringer rails 40.

Each retainer bar 22 is molded with a plurality of downwardly depending plugs, generally at 72, with each plug 72 underlying an associated spine bore 70. Each plug 72 has a generally cylindrical side wall 74 that is molded using the same resilient material, such as polyurethane which is used to mold the rest of the retainer bar 22 about the metal spine 50. Each plug 72 is attached to the lower face 62 of the retainer bar and has a free lower plug end 76. A central passage 78 extends down each plug, generally along a centerline of the cylindrical plug. The central passage 78 of each plug is aligned with the bore 70 in the spine 50, which is situated above, the plug 72, and with the chamfer 68 in the upper face 60 of the retainer bar 22.

A threaded expansion nut 80 is molded into each plug generally adjacent the plug lower end 76. The threaded expansion nut 80 is aligned with the central passage way 78 in each such plug 72. Each expansion nut 80 has a central threaded sleeve 82, a radially extending flange wall 84 and several circumferentially spaced barbs 86. The barbs 86 are cut into the flange wall 84 and are bent upwardly. They act as rotation prevention anchors so that the expansion nut 80 will not rotate in the plug 72 when it is engaged by a cooperating threaded expansion bolt, as will be discussed shortly.

Each plug 72 has, as was recited above, a generally cylindrical side wall 74. Adjacent its connection with the underside 62 of the retainer bar 22, each plug sidewall 74 is undercut, as indicated at 90. This undercut 90 has a height slightly less than the wall thickness of the screen stringer rail 40. The lower edge of the undercut 90 is defined by a small, radially outwardly extending lip or flange 92. That lip 92 is slightly greater in diameter than the cylindrical plug sidewall 74 and is preferably also slightly greater in diameter than is the diameter of the hole 44 on the upper face 46 of the screen stringer rail 40.

In use, when the retainer bars 22 are initially placed on the screen stringer rails 40, the plugs 72 will be received in the rail holes 44 so that the body of the plug, up to the lip or flange 92 will be within the hollow interior of the rail 40. This may be seen most clearly in FIG. 6. In this position, the retainer bar 22 is now connected to the stringer rail 40 so that it will not be dislodged by casual movement of the stringer rails 40. Once the retainer bars 22 have been so placed, a threaded shank 94 of an expansion bolt, generally at 96, is inserted through the spine bore 70, down the plug central passage 78 and into engagement with the expansion nut 80. An enlarged head 98 of the expansion bolt abuts an upper surface of the metal spine 50. Since the spine bore 70 is not threaded, rotation of the expansion bolt 96 such as by engagement of a suitable tool with the bolt head 98, which may be provided with a hex socket, which is not specifically shown, will result in movement of the expansion nut 80 axially along the bolt shank 94. Movement of the expansion nut 80 toward the bolt head 98 will result in an axial shorting of the plug 72 and a coincidental radial widening, as depicted in FIG. 7. It will be understood that the radial widening, or the increase in the diameter of the plug 72, in response to a decrease in the distance between the bolt head 98 and the expansion nut 72 will preclude removal of the now radially enlarged plug 72 from the interior of the screen stringer rail. The diameter of the plug 72 has been increased sufficiently so that it will now not pass through the rail hole 44.

As the dimension of the rail hole 44 increases over time, which increase is, a result of the operation of the machine to separate abrasive slurries, it is possible to further draw up the expansion nut toward the bolt head 98 and toward the spine 50. Within limits, this capability of the retainer bar 22 of the screen panel retainer system of the present invention allows the use of one set of screen stringer rails 40 for a longer period of time than had previously been possible. Longer stringer rail life means less machine down time. So long as the plug diameter can be increased by further axial movement of the expansion nut 80 toward the metal spine 50, the retainer bar 22 can be held in place on the screen stringer rails 40.

Each retainer bar 22 is essentially the same length as a screen panel 28 which will be secured to the frame of the vibrating separatory machine 30, as may be seen in FIG. 1. The structure of each screen panel 28 and the screen edge strip 24 will be discussed in detail shortly. Each screen panel 28 is provided with two such screen edge strips 24 and these screen edge strips 24 are configured so that they can be releasably secured to the retainer bars 22, once the retainer bars 22 have been attached to the screen stringer rails 40 in the manner as has been set forth above.

Each retainer bar 22, as may be seen most clearly in FIGS. 4 and 5, has a plurality of upwardly extending ears, generally at 100, which ears 100 are molded integrally with the rest of the resilient retainer bar. The plurality of these ears 100 are symmetrical about a transverse center line of the retainer bar 22 so that each retainer bar 22 can be installed without respect to its longitudinal orientation. Each ear 100 is somewhat V-shaped in side view; i.e. in a view transverse to the flow direction 14 of material along the screen panels. Each ear includes an ear base 102 and a pair of upwardly extending lugs 104. The upper, free end of each ear lug 104 terminates in an ear hook 106. These ear hooks 106 are each essentially tongues that will fit into cooperating shaped grooves in the screen edge strips 24, as will be discussed subsequently. Each ear hook 106 is somewhat rectangular in side elevation view and has a hook end 108. The shape of each ear 100 and its fabrication of a resilient material, such as polyurethane, gives each ear 100 a certain amount of flexure. This accomplishes the snap-fit of the ears into the screen edge strips 24 during mounting of the screen panels 28 onto the screen stringer rails 40. The longitudinal ends of each retainer bar 22 are provided with half-ears 110. These half-ears. 110 are similar in structure and function to the ears 100 but only include one lug 104 and one hook 106. In some instances, the two lugs 104 of an ear 100 are spaced apart a sufficient distance to lengthen the ear base 102 so that an expansion bolt 96 can pass through the ear base 102 and into an underlying securement plug 72. As may be seen most clearly in FIG. 4, the ears 100 are concentrated at the longitudinal ends of each retainer bar 22. They are also spaced evenly along the length of each bar 22 intermediate its ends.

Figure 3:
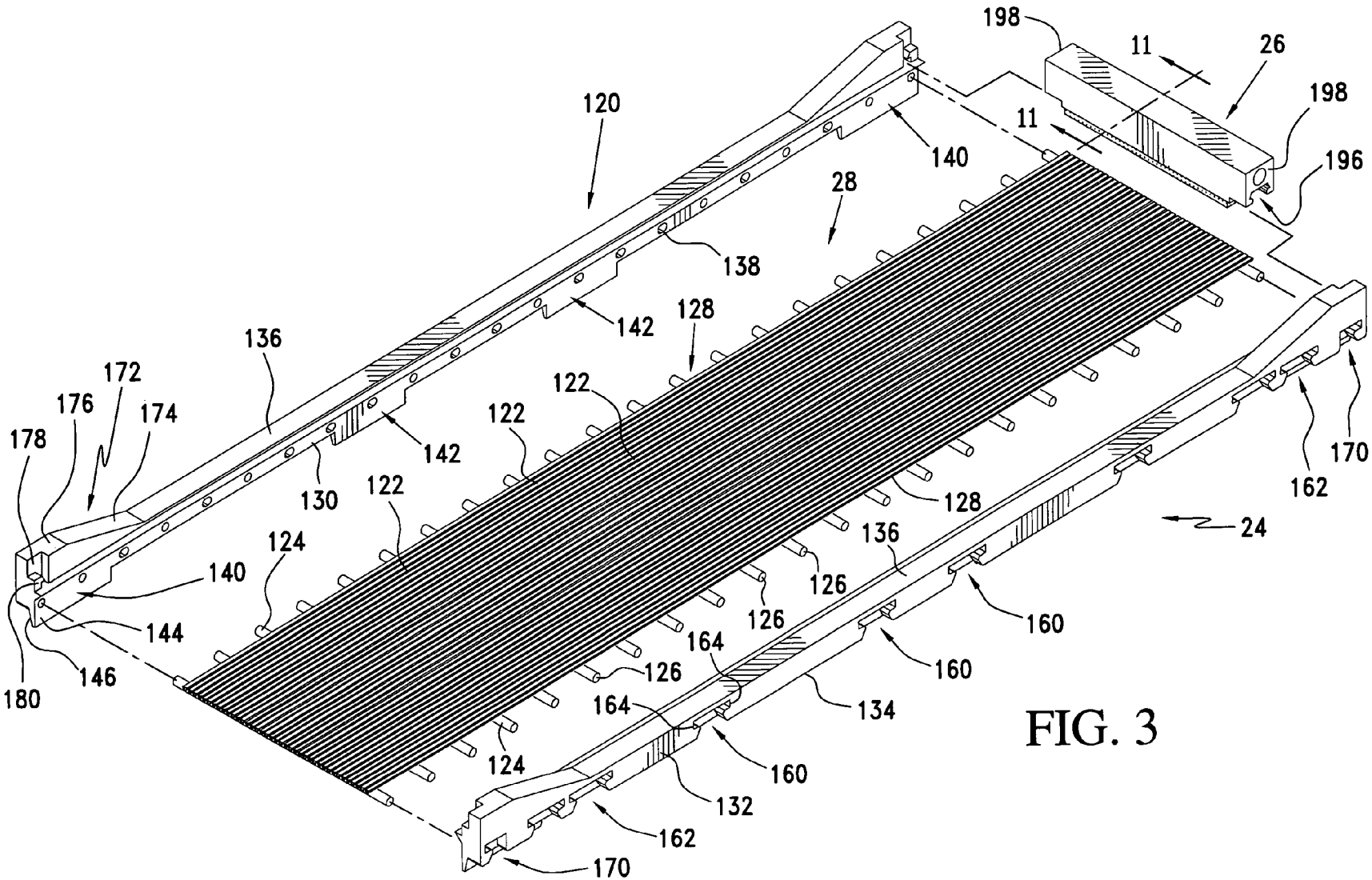
FIG. 3 is an exploded perspective view of a screen panel assembly which includes the screen edge strip and end dam of the present invention.

Referring now primarily to FIG. 3, there may be seen a screen panel assembly, generally at 120, which screen panel assembly is representative of a plurality of screen panels that will be secured to the base of the vibrating separatory machine 30 using the screen panel retainer system 20 of the present invention. Each screen panel assembly 120 includes a screen panel 28 and a pair of screen edge strips 24. The screen panel itself is generally conventional and does not form a part of the subject invention. As is known to those familiar with vibrating separatory machines, each screen panel includes a plurality of profile wires 122 which extend in the flow direction A and which are secured, typically by welding, to underlying, transverse tie rods 124. These tie rods 124 are typically circular in cross-section, are spaced equally along the length of each screen panel 28 and have tie rod end 126 that extend laterally beyond the outermost ones of the profile wires 122.

Each screen panel 28 is bounded, on its two lateral sides 128 by a screen edge strip 24. Each such screen edge strip 24 is a one piece molded element which is also typically made of polyurethane. It may be somewhat more flexible and resilient than the retainer bar 22 with which it cooperates. Each screen edge strip 24 has an inner face 130, an outer face 132, a bottom surface 134 and a top surface 136. The inner face 130 of each screen edge strip 24 is molded with a plurality of spaced blind bores 138. These blind bores 138 are dimensional and spaced so that they will receive the tie rod ends 126 of the tie rods 124 of the screen panels 28. It may be desirable to make these blind bores 138 somewhat ovoid so that they will accommodate tie rod ends 126 that may be slightly bent or out of line. The blind bores 138 typically do not extend completely through the width of each screen edge strip 24.

Figure 8:
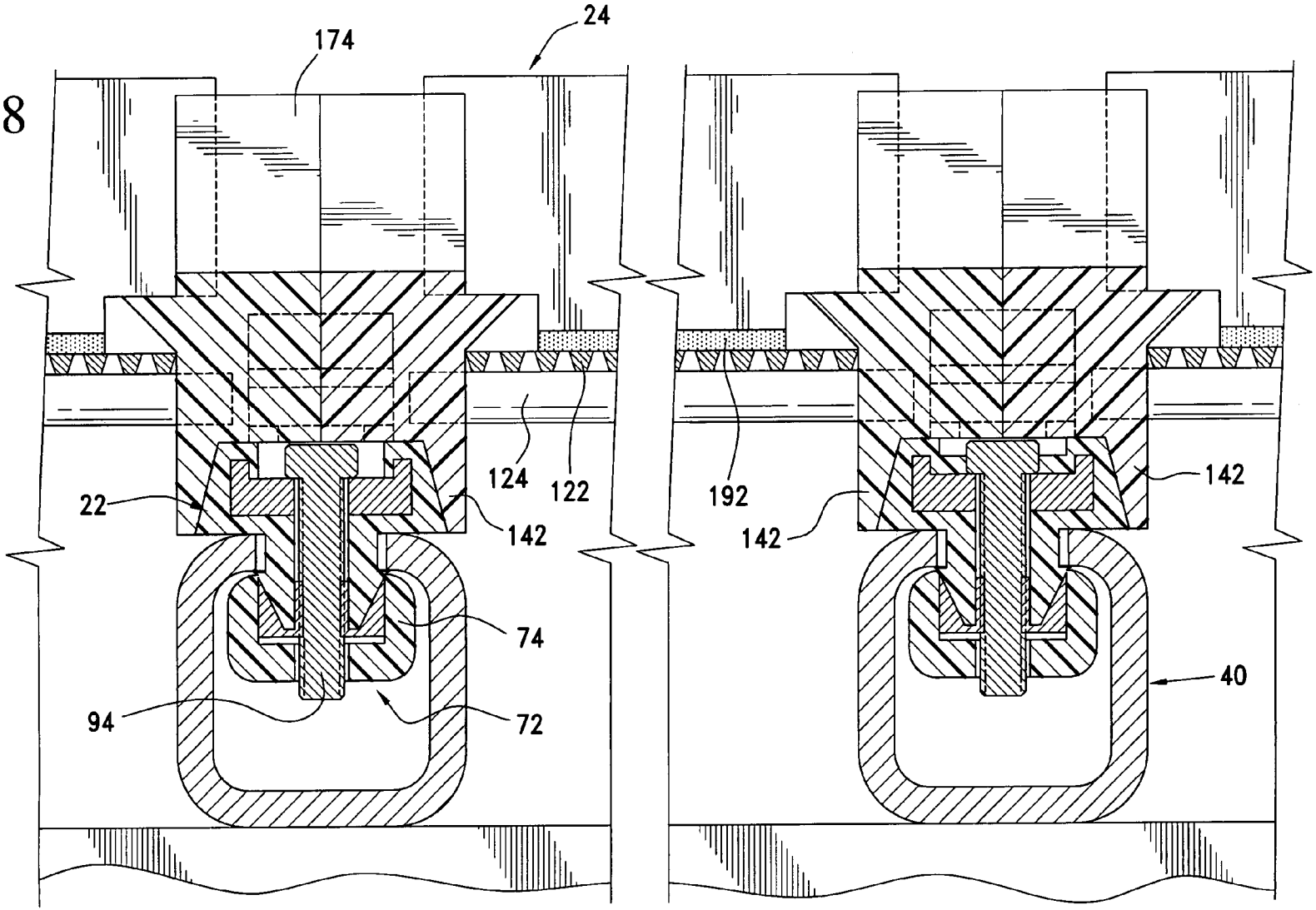
FIG. 8 is a cross-sectional view of a portion of the separatory machine, taken along line 8—8 of FIG. 1 and showing several center retainers and end dams in accordance with the present invention being used to secure several screen panels to the screen stringer rails.

Each end of the screen edge strip inner face 130 has a downwardly extending end flange or key 140. Several other similar intermediate flanges or keys 142 are spaced along the length of the inner face 130. These flanges or keys 140 and 142 are generally rectangular in side view and are somewhat wedge-shaped in end view, as may be seen in FIGS. 8 and 10. These flanges or keys 140 and 142 have generally planar inner faces 144 and inclined outer faces 146.

Each screen edge strip key 140 or 142 is dimensioned to be securable in a cooperating shaped cut-out or keyway 150 on the retainer bar 22 to which the screen edge strip 24 will be attached. As may be seen in FIG. 5, each keyway 150 has an inclined face 152 whose slope is complementary to the slope of the outer face 146 of the key 140 or 142. These keys 140 and 142, and their cooperating keyways 150 insures that the screen panel screen edge strip 24 will be properly aligned with the retainer bars 22.

Figure 2:
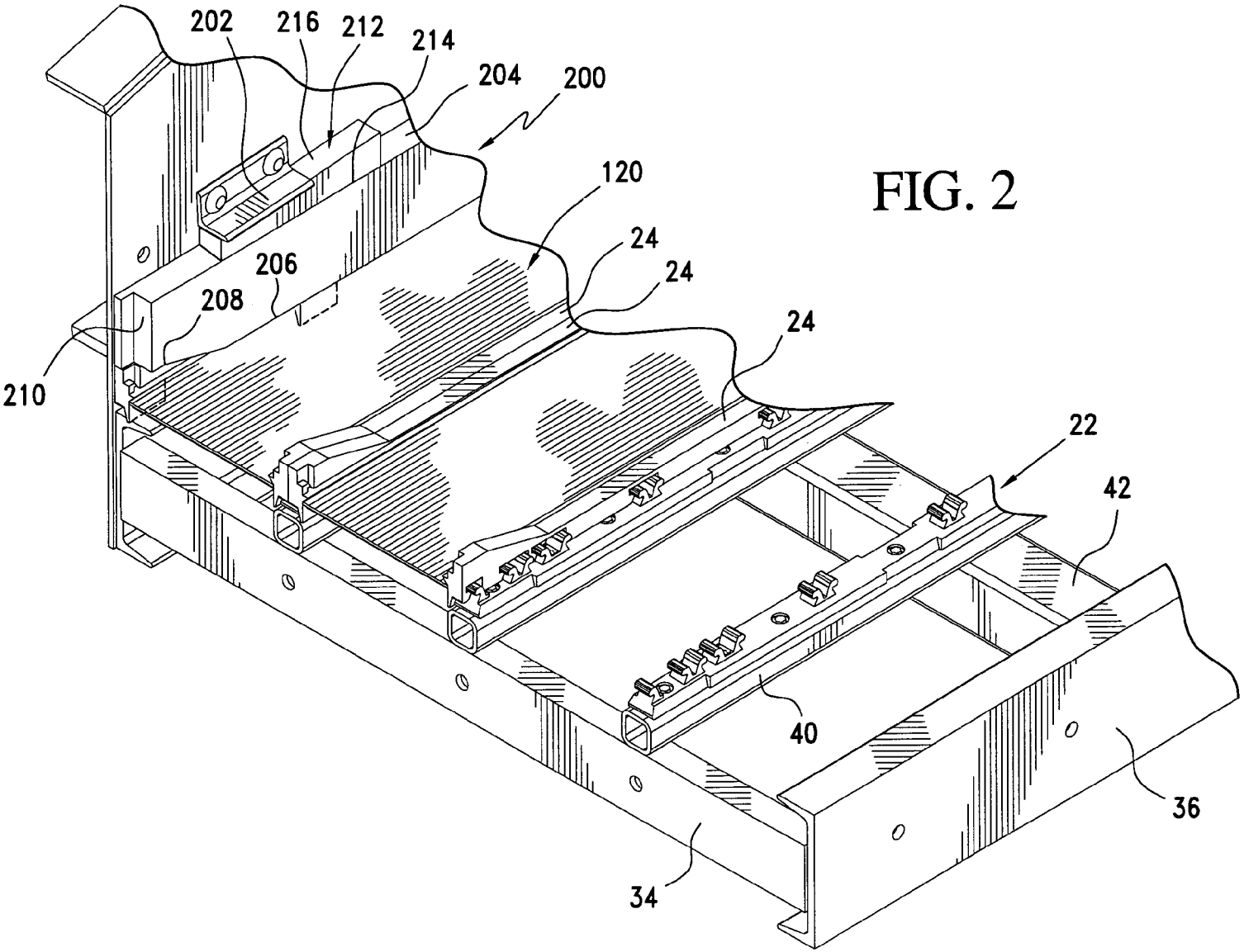
FIG. 2 is an enlarged perspective view of a portion of the vibrating separatory machine with several screen panels removed to show the retainer system.

The outer face 132 of each screen edge strip 24 is generally planar and is provided with a plurality of retainer ear receiving pockets 160. Each pocket 160, except for two end pockets 168, is generally T-shaped in plan view. Its depth is less than the width of each edge strip 24. Each edge strip 24 pocket has a depth that is approximately half of the width of a corresponding retainer bar ear 100. The pockets 160 each have a pair of grooves 164 that extend longitudinally from a central passage 166. The pocket grooves 164 are dimensioned to receive the ear hooks 106. This assembled configuration can be seen in FIG. 2 which shows several screen panel assemblies 120 secured to retainer bars 22 with several screen panel assemblies 120 yet to be installed. Various reference numerals and their lead lines have been left off FIG. 2 for ease of illustration. As seen in FIG. 2, a pair of screen panel assemblies 120 are secured to each retainer bar 22. The planar outer faces 132 of adjacent screen edge strips 24 abut each other to provide a tight joint between laterally adjacent screen panel assemblies 120. The screen panel assemblies 120 typically are supplied with the edge strips 24 in place. Installation is accomplished by simply placing the edge strips 24 in proper alignment above the cooperating retainer bars 22 and by exerting sufficient downward force to cause the ear lugs 104 to flex sufficiently so that the ears will pass up through the pocket central passages 166. The ear hooks 106 will then displace out into the pocket grooves 164. Since the retainer bars 22 have half ears 110 at their ends, the edge strips 24 have corresponding half pockets 170 at their ends 172.

Again referring to FIGS. 3 and 4, the screen edge strip ends 172 have end ramps 174 that lead to end blocks 176. Each screen edge strip end block 176 is provided with an inner keyway 178 that terminates in an inverted half ear 180. The inverted half ear 180 has an ear hook 182 that is generally similar to the ear hooks 106 described previously in connection with the retainer bar ears 100.

Figure 9:
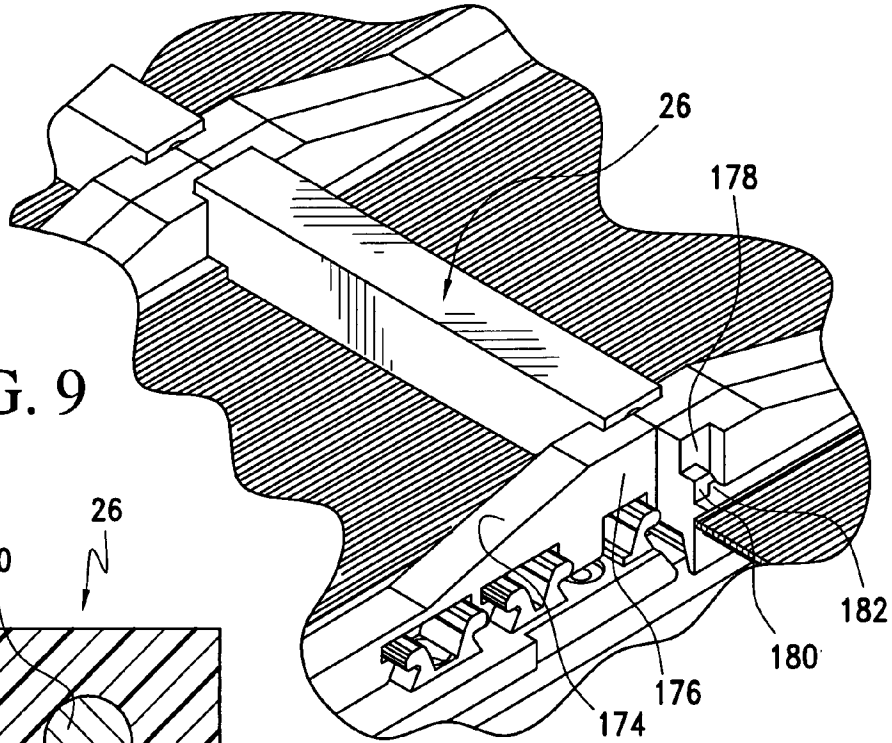
FIG. 9 is a perspective view of an enlarged portion, shown encircled in FIG. 1, of ends of several adjacent screen panels and showing the center retainer bars, screen panel edges and an interlocking dam, all in accordance with the present invention.
Figure 11:
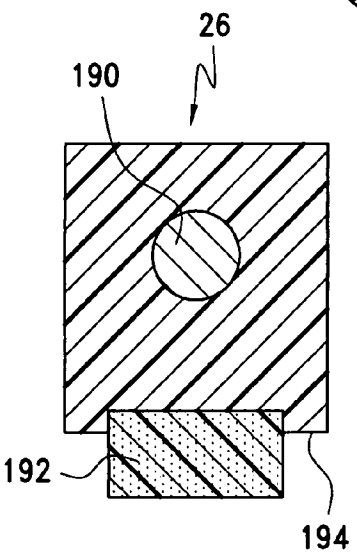
FIG. 11 is a cross-sectional view of a dam taken along line 11—11 of FIG. 3.

As depicted in the exploded view of FIG. 3, as seen in FIG. 9, and as also represented in FIG. 1, a plurality of dams 26 are each in cooperation with the screen edge strips 24. These dams 26 further secure the screen panel assemblies 120 in place and also act, in their more conventional manner, as flow turbulence increasing devices. As seen FIG. 11, each dam 26 is generally square in cross-section and is molded of polyurethane with a central, axially extending steel reinforcing bar 190. A resilient seal strip 192 is attached to a bottom surface 194 of the dam 26. As depicted in FIG. 3, each dam 26 has dam end pockets 196 at either end 198. These dam end pockets 196 are essentially the same, in overall configuration as the screen edge strip pockets 160. A width of each dam 26 is essentially twice the width of a screen edge strip inner keyway 178. By referring to FIG. 9, it can be seen that a dam 26 will be positionable between the spaced screen edge strips of abutting ends of two longitudinally adjacent screen panel assemblies 120 and will act to tie the two screen panel assemblies 120 together. Each screen edge strip inner keyway 178 is essentially half of the width of a dam 26. Two inner keyways 178, on adjacent edge strip ends, form an inner keyway that will receive a dam end 198. The dam ends 198 are held in place in the inner keyways 178 by the cooperation of the edge strip end inverted half ears 180 with the dam end pockets 196. The inverted half ear hooks 182 will be received into the pockets 196 on the dam ends 198 in the same manner and with the same result as was discussed previously in connection with the retainer bar ears 100 and half ears 110 and their cooperating screen edge strip pockets 160 and half pockets 170.

Figure 10:
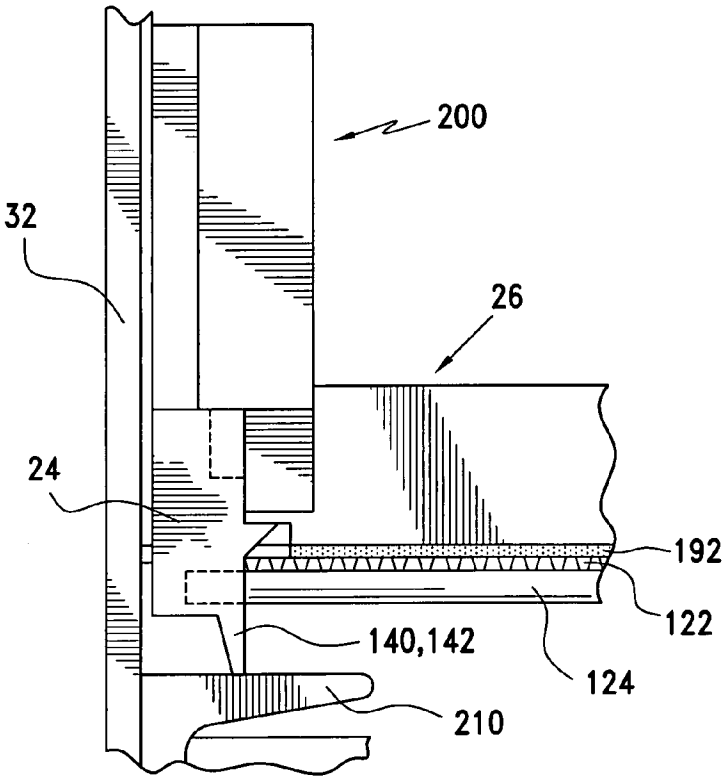
FIG. 10 is an enlarged view of an end portion of one side plate of a vibrating separatory machine and showing a side retainer bar and dam of the present invention.

Attachment of the screen panel assemblies 120 to the side panels 32 of the vibrating separatory machine 30 is accomplished by using the side panel structure typically found in vibrating separatory machines. A side board, generally at 200, as seen in FIGS. 1 and 2, is structured to cooperate with typical inclined wedge plates 202 that are bolted or otherwise secured to the side panels 32. Each side board 200 is generally an elongated beam which has a planar upper surface 204 and a lower surface 206 with angled ends 208. The lower surface 206 of each side board 200 is complementary, in shape, to the upper surface 136 of a screen edge strip 24. The angled ends 208 of the lower surface 206 of the side board 200 will engage the end ramps 174 and end block 176 of the edge strip 24. The lower flanges or lugs 140 and 142 of the screen edge strips 24 are, as seen in FIG. 2 and 10, supported by upper lugs 210 of the channel iron frame members 36.

During installation of the screen panel assemblies 120 on the vibrating separatory machine 30, the panel assemblies 120 are laid onto the screen stringer rails 40 with the screen edge strips 24 aligned with the retainer bars 22 that have previously be attached to the tops 46 of the screen stringer rails 40, as was discussed above. The side boards 200 are initially not in place. Once all of the screen panels have been put down onto the retainer bars 22 and the ears 100 and half ears 110 have been pushed into the pockets and half pockets 160 and 170, the side boards 200 are then put in place. Each side board has a key slot 210 at each of its ends. The key slots 210 are the same width as the inner keyways 178 on the screen edge strip ends. Once all of the screen panels have been put in place, the side boards 200 are moved laterally into contact with the side plates 32. This lateral movement is guided by the cooperative shapes of the side board bottom surface 206 and the complementary upper face of the screen edge strips 24. The various dams 24 are then installed, as was discussed above. The side board end key slots 210 of abutting side boards 200 receive the outer end of the outward dams, as depicted in FIG. 1. The dam end passes down through its slots and engages the inverted half ears 180 in the screen edge strip end blocks 176. Once this assembly is complete, wedge blocks 212 are driven into place, as shown in FIG. 2. These wedge blocks have lower planar surfaces 214 and upper inclined surfaces 216. The lower, planar wedge block surfaces 214 contact the upper surface 204 of the side boards 200. The upper wedge block inclined surfaces 216 engage the inclined wedge plates 202 which are attached to the side panels 32 of the vibrating separatory machine 30.

Removal of a screen panel assembly 120 or of a plurality of screen panel assemblies 120 is accomplished by reversal of the installation procedure. The wedge blocks 212 can be hammered out and the outer dams 24 can be pried up using a tool such as a pry bar or a screwdriver. The side boards 200 can be moved laterally. Now any desired screen panel assembly 120 can be removed by removal of the overlying dams 24 and by separation of the screen edge strips 24 from their associated retainer bars 22. It is preferable to start such a separation at a screen panel end. Once a screen panel end has been raised, the entire panel assembly 120 can be pulled up. The resilient ears and half ears on the retainer bar are pulled out of their pockets and half pockets, leaving the retainer bars 22 in place. If it is determined that the retainer bars 22 are no longer as securely attached to the screen stringer rails 40 as they were on initial installation, typically due to stringer rail holes 44 becoming enlarged, the expansion bolts 96 can be tightened. This will further draw the expansion nuts 80 up toward the undersurface of the retainer bars and will increase the radial dimension of the plugs, as depicted in FIG. 7. Such an increase in radial plug dimension will further insure that the retainer bars 22 are, and will remain secured to the screen stringer rails 40. If it is necessary to remove the screen retainer bars 22 from the screen stringer rails 40, this can be accomplished by backing off the expansion bolts 96. This will move the expansion nuts 80 down the bolt shank 94 away from the bolt head and will decrease the radial dimension of the retainer bar plugs 72. The plugs 72 can then be pulled out of the holes 44.

The screen panel retainer system of the present invention overcomes the limitations of prior systems. It is adaptable for use with various separatory machines and does not require any machine modifications. The retainer bars are configured to fit the industry standard screen stringer rail hole pattern. No additional plugs, pins, inserts or other ancillary securement devices are required. Screen panel assemblies snap fit onto the retainer bars using only foot pressure. Once in place, with the dams installed, the system is tied or keyed together so that it is very unlikely that a panel will become dislodged. However, panel removal, if necessary, is quickly accomplished. The screen panel retainer system of the present invention thus is clearly a substantial advance in the art.

While a preferred embodiment of a screen panel retainer system in accordance with the present invention has been set forth fully and completely hereinabove, it will be apparent to one of skill in the art that changes in, for example, the particular resilient material used, the type of profile wire used on the screen panels, the number of panels secured to a machine frame and the like could be made without departing from the true spirit and scope of the present invention, which is to be limited only by the appended claims.

What is claimed is:

1. A screen panel retainer system comprising:

a plurality of retainer bars each of said retainer bars being formed of a resilient material and including an upper face and a lower face;

a plurality of spaced resilient plugs extending downwardly from said lower face of each said retained bar, each said plug being formed of said resilient material and being integral with said lower face of each said retainer bar;

means for reversibly increasing a radial dimension of each said resilient plug;

a plurality of spaced upwardly extending ears on said upper face of each said retainer bar;

screen edge strips adapted to be securable to screen panels;

a plurality of spaced, individual pockets on each of said screen edge strips, each of said plurality of spaced, individual pockets being configured to receive one of said spaced, upwardly extended ears; and dams securable to ends of adjacent ones of said screen edge strips.

2. The screen panel retainer system of claim 1 further including a metal spine in each said retainer bar.

3. The screen panel retainer system of claim 1 further including an expansion nut in each of said plugs.

4. The screen panel retainer system of claim 3 wherein said means for increasing a radial dimension of each said plug includes an expansion bolt, said expansion bolt being engageable with said expansion nut, movement of said expansion nut relative to said lower face of each said retainer bar varying said radial dimension of each said plug.

5. The screen panel retainer system of claim 4 further including barbs on each said expander nut, said barbs preventing rotation of said expander nut in said plug.

6. The screen panel retainer system of claim 4 further including a hole in each said retainer bar overlying each said plug, said hole being adapted to allow passage of said expansion bolt to said expansion nut.

7. The screen panel retainer system of claim 6 wherein each said hole is unthreaded.

8. The screen panel retainer system of claim 1 further including a half pocket at each end of said screen edge strip.

9. The screen panel retainer system of claim 8 further including a half ear at each end of each said retainer bar, said half ears being adapted to be secured in said half pockets.

10. The screen panel retainer system of claim 1 wherein each said dam includes a pair of dam ends, each said dam end having a dam end pocket.

11. The screen panel retainer system of claim 10 further including screen edge strip end keyways, said keyways including inverted ears, said dam end pockets being adapted to receive said inverted ears.

12. The screen panel retainer system of claim 1 further including key flanges on each said screen edge strips and complimentary keyways on each said retainer bar.

13. The screen panel retainer system of claim 12 wherein each said key flange is situated along a side edge of each said screen edge strip.

14. The screen panel retainer system of claim 1 wherein each said plug is adapted to be received in a hole in a screen stringer rail of a separatory machine.

15. The screen panel retainer system of claim 1 further including side boards engageable with a side panel of a separatory machine.

16. A screen panel retainer system comprising:

a plurality of retainer bars, each of said retainer bars including an upper face and a lower face;

a plurality of snaced plugs extending downwardly and being integral with said lower face of each said retainer bar;

means on each said retainer bar for reversibly increasing a radial dimension of each said plug;

a plurality of spaced upwardly extending ears on said upper face of each said retainer bar, each said ear including at least one ear lug and at least one ear hook;

screen edge strip adapted to be securable to screen panels;

a plurality of pockets on each of said screen edge strips, said pockets being configured to each receive one of said ears; and dams securable to ends of adjacent ones of said screen edge strips.

17. The screen panel retainer system of claim 16 wherein said ear hook is transverse to a longitudinal direction of said retainer bar.

18. The screen panel retainer system of claim 16 wherein each said pocket includes at least one pocket end, each said pocket end being adapted to receive one of said ear hooks.

19. A screen panel retainer system comprising:

a plurality of retainer bars, each of said retainer bars including an upper face and a lower face;

a plurality of spaced plugs extending downwardly and being integral with said lower face of each said retainer bar;

means on each said retainer bar for reversibly increasing a radial dimension of each said plug;

a plurality of spaced upwardly extending ears on said upper face of each said retainer bar;

screen edge strips adapted to be securable to screen panels;

a plurality of pockets on each of said screen edge strips, said pockets being configured to each receive one of said ears, each of said pockets being generally T-shaped; and dams securable to ends of adjacent ones of said screen edge strips.

* * * * *